US008425347B2

(12) United States Patent
Jertson et al.

(10) Patent No.: US 8,425,347 B2
(45) **Date of Patent: *Apr. 23, 2013**

(54) GOLF CLUB HEAD WITH REINFORCED CROWN

(75) Inventors: Marty R. Jertson, Phoenix, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/469,888

(22) Filed: May 11, 2012

(65) Prior Publication Data

US 2012/0225737 A1 Sep. 6, 2012

Related U.S. Application Data

(63) Continuation of application No. 12/541,817, filed on Aug. 14, 2009, now Pat. No. 8,206,242, which is a continuation-in-part of application No. 12/430,821, filed on Apr. 27, 2009, now Pat. No. 7,874,935, which is a continuation of application No. 12/047,957, filed on Mar. 13, 2008, now Pat. No. 7,563,177, which is a continuation of application No. 11/496,216, filed on Jul. 31, 2006, now Pat. No. 7,396,298.

(51) Int. Cl.
*A63B 53/04* (2006.01)

(52) U.S. Cl.
USPC ..... 473/332; 473/345; 473/346

(58) Field of Classification Search ..... 473/324–350
See application file for complete search history.

(56) References Cited

U.S. PATENT DOCUMENTS

| | | | | |
|---|---|---|---|---|
| 4,214,754 | A * | 7/1980 | Zebelean | 473/346 |
| 4,432,549 | A * | 2/1984 | Zebelean | 473/346 |
| 4,681,321 | A | 7/1987 | Chen et al. | |
| 5,067,715 | A * | 11/1991 | Schmidt et al. | 473/332 |
| 5,180,166 | A | 1/1993 | Schmidt et al. | |
| 5,213,328 | A | 5/1993 | Long et al. | |
| 5,351,958 | A * | 10/1994 | Helmstetter | 473/346 |
| 5,419,559 | A * | 5/1995 | Melanson et al. | 473/346 |
| 6,059,669 | A | 5/2000 | Pearce | |
| 6,595,871 | B2 * | 7/2003 | Sano | 473/342 |
| 6,645,087 | B2 * | 11/2003 | Yabu | 473/342 |
| 6,783,465 | B2 * | 8/2004 | Matsunaga | 473/329 |
| 6,852,038 | B2 * | 2/2005 | Yabu | 473/224 |
| 7,250,007 | B2 * | 7/2007 | Lu | 473/329 |
| 7,273,423 | B2 | 9/2007 | Imamoto | |
| 7,396,298 | B2 * | 7/2008 | Jertson et al. | 473/346 |
| 7,507,168 | B2 * | 3/2009 | Chou et al. | 473/346 |
| 7,563,177 | B2 * | 7/2009 | Jertson et al. | 473/332 |
| 7,749,104 | B2 * | 7/2010 | Brekke et al. | 473/345 |
| 7,806,781 | B2 | 10/2010 | Imamoto | |
| 7,828,676 | B2 * | 11/2010 | Wada et al. | 473/346 |
| 7,874,935 | B2 * | 1/2011 | Jertson et al. | 473/332 |
| 7,887,433 | B2 * | 2/2011 | Hoffman et al. | 473/327 |
| 8,206,242 | B2 * | 6/2012 | Jertson et al. | 473/332 |

(Continued)

FOREIGN PATENT DOCUMENTS

| | | |
|---|---|---|
| CA | 2471397 A1 | 6/2006 |
| CN | 2636914 Y | 9/2004 |

(Continued)

*Primary Examiner* — Alvin Hunter

(57) ABSTRACT

A golf club head with reinforced crown is described herein. Other embodiments are also disclosed herein.

23 Claims, 7 Drawing Sheets

U.S. PATENT DOCUMENTS

| | | | | |
|---|---|---|---|---|
| 2002/0065147 | A1* | 5/2002 | Sano | 473/346 |
| 2002/0072434 | A1 | 6/2002 | Yabu | |
| 2003/0104878 | A1 | 6/2003 | Yabu | |
| 2003/0114244 | A1* | 6/2003 | Matsunaga | 473/345 |
| 2004/0266551 | A1 | 12/2004 | Noguchi et al. | |
| 2005/0049081 | A1* | 3/2005 | Boone | 473/346 |
| 2005/0221913 | A1* | 10/2005 | Kusumoto | 473/345 |
| 2006/0052181 | A1 | 3/2006 | Serrano et al. | |
| 2008/0070721 | A1* | 3/2008 | Chen et al. | 473/346 |
| 2010/0029408 | A1 | 2/2010 | Abe | |

FOREIGN PATENT DOCUMENTS

| | | | | |
|---|---|---|---|---|
| EP | 1757335 | A1 | | 2/2007 |
| GB | 2417909 | | | 3/2006 |
| GB | 2440511 | A | | 2/2008 |
| JP | 04327864 | A | * | 11/1992 |
| JP | 09154984 | A | * | 6/1997 |
| JP | 2001095957 | A | * | 4/2001 |
| JP | 2001353240 | A | * | 12/2001 |
| JP | 2002126136 | A | * | 5/2002 |
| JP | 2002239641 | A | * | 8/2002 |
| JP | 2003159354 | | | 6/2003 |
| JP | 2005137788 | A | | 6/2005 |
| JP | 2005237948 | A | * | 9/2005 |
| JP | 2005287529 | A | * | 10/2005 |
| JP | 2005312942 | A | | 11/2005 |
| JP | 2005073736 | | | 3/2006 |

* cited by examiner

GOLF CLUB HEAD WITH REINFORCED CROWN

CLAIM OF PRIORITY

This application is a continuation of U.S. patent application Ser. No. 12/541,817, filed on Aug. 14, 2009, which is a continuation-in-part of U.S. patent application Ser. No. 12/430,821, filed on Apr. 27, 2009, now U.S. Pat. No. 7,874,935, which is a continuation of U.S. patent application Ser. No. 12/047,957, filed on Mar. 13, 2008, now U.S. Pat. No. 7,563,177, which is a continuation of U.S. application Ser. No. 11/496,216, filed on Jul. 31, 2006, now U.S. Pat. No. 7,396,298. The contents of the disclosures listed above are incorporated herein by reference.

TECHNICAL FIELD

The present invention generally relates to golf equipment and, more particularly, to golf club heads.

BACKGROUND

Modern wood-type golf club heads are now almost exclusively made of metal rather than the persimmon wood that gave the clubs their name. These club heads are generally constructed as a hollow metal shell with a relatively thick face to withstand the ball impact and a relatively thick sole to withstand grazing impact with the ground as well as lowering the center of gravity of the club head. The remainder of the club head is manufactured as thin as possible so as to allow the maximum amount of material to be dedicated to the face and sole portions. Although the crown and skirt of a modern club head are quite thin, they still must be sufficiently rigid in the direction of the maximum stress in order to provide support for the face of the club head.

Ribs have commonly been employed in the crowns of club heads to enable the crowns to be as lightweight as possible while still providing sufficient stiffness in the fore and aft direction. U.S. Pat. No. 4,214,754 to Zebelean discloses a hollow club head with a crown that includes parallel ribs running perpendicular to the face of the club head that extend internally and bridge the thin transition with the crown. Similarly, U.S. Pat. No. 6,595,871 to Sano discloses a hollow club head with a separately attached face and a crown that includes a plurality of parallel ribs extending perpendicular to the face. U.S. Pat. No. 5,067,715 to Schmidt et al discloses a hollow club head that includes a crown with a plurality of parallel ribs that merge into and run perpendicularly to the club head face as well as a plurality of ribs that merge into and run perpendicularly to a rear wall of the club head.

The prior art fails to recognize that a club head having a crown with parallel ribs that uniformly reinforce the face of the club head is not an efficient structure since the club head face is not uniformly loaded but is subjected to essentially a point impact near its center.

DESCRIPTION

Figure 1:
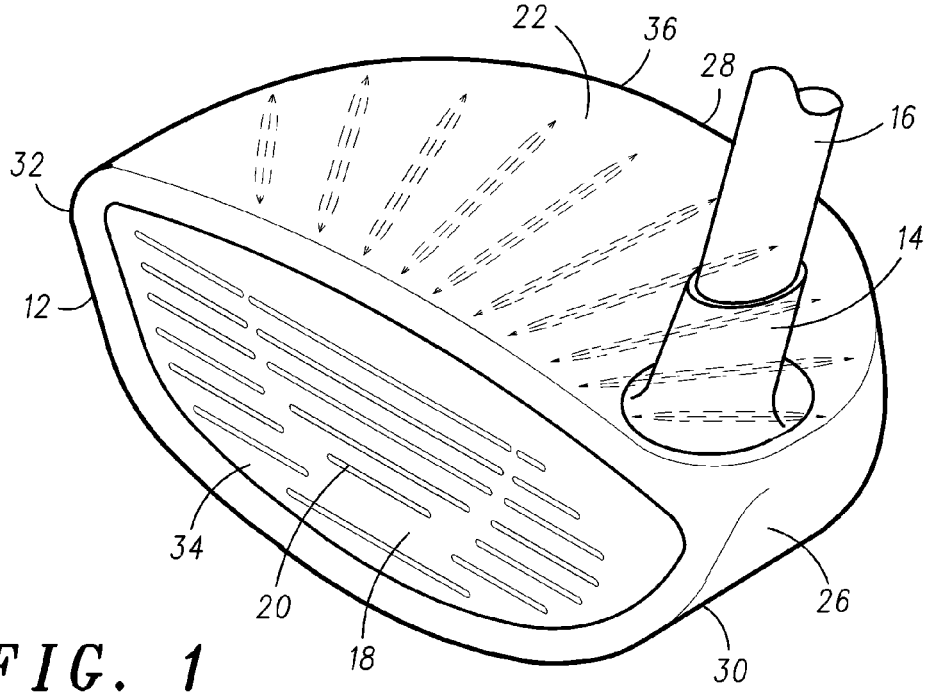
FIG. 1 is a front perspective view of a golf club head incorporating features of the present invention.
Figure 3:
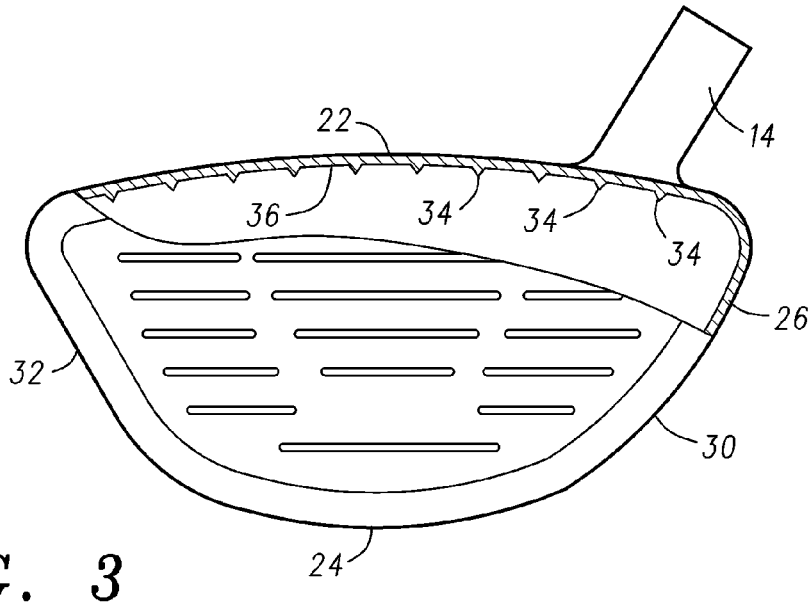
FIG. 3 is a partial cross-sectional view of the club head of FIG. 1 viewed from the front.
Figure 2:
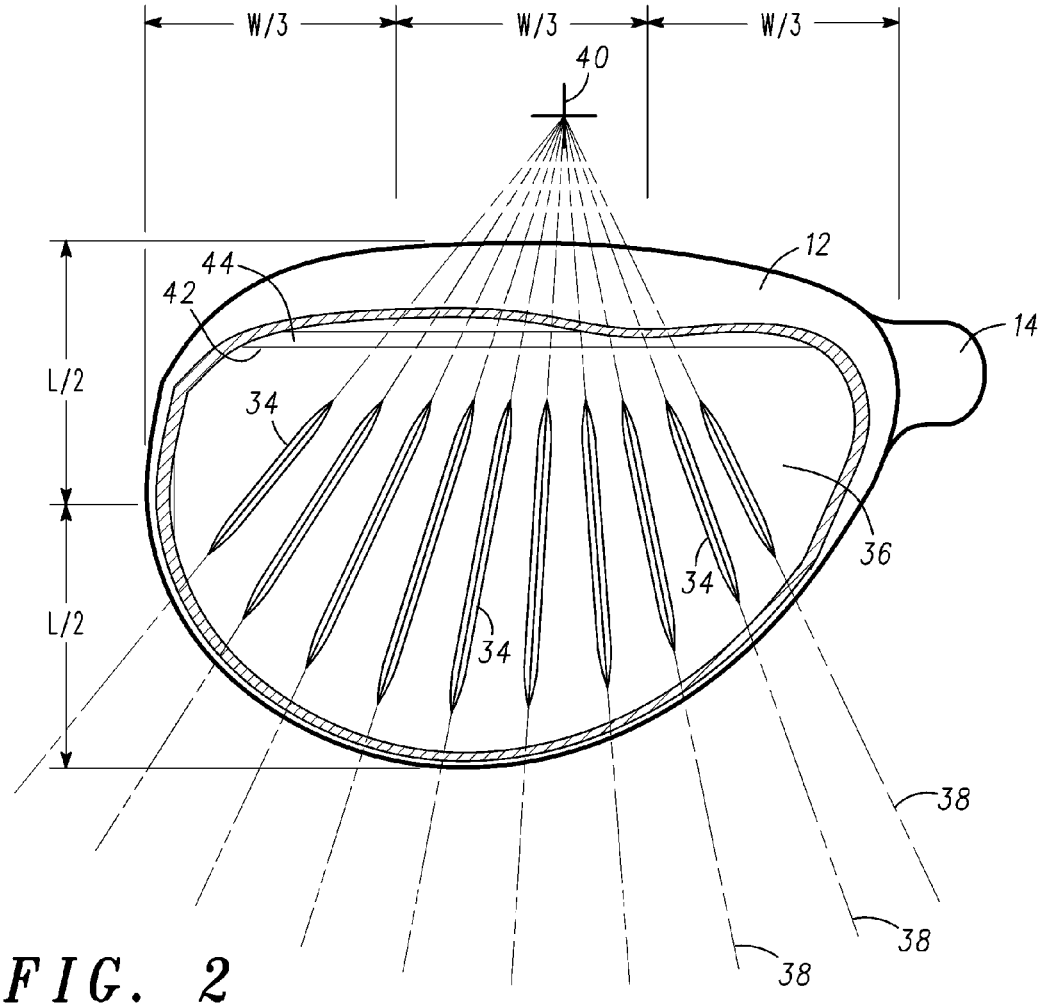
FIG. 2 is a cross-sectional view of the club head of FIG. 1 viewed from below.

With reference to FIGS. 1-3, golf club 10 comprises a club head 12, a hosel 14 and a shaft 16. Club head 12 is composed of a hollow body 18, typically made of stainless steel, titanium or other material having a high shear modulus of elasticity and high strength-to-weight ratio. Hollow body 18 comprises a front wall or face 20 adapted for impacting a golf ball. Hollow body 18 further comprises a top wall or crown 22, a bottom wall or sole 24, and a side wall or skirt 26 that connects the face 20 to crown 22 and sole 24. Club head 12 further includes a heel end 30 and a toe end 32. Skirt 26 wraps around the club head 12 between the heel and toe ends 30, 32 to form a rear wall 28. Golf club head 12 can be a golf club head for a driver type club, a fairway wood, or a hybrid club.

Crown 22 comprises a thin walled structure preferably cast as part of hollow body 18. Crown 22 is preferably titanium having a relatively thin thickness dimension of 0.076 centimeters (cm)±0.013 cm. Crown 22 is reinforced with a plurality of ribs 34 extending downward from lower surface 36 of crown 22. Each rib 34 extends from a first end proximal, but spaced from, the front wall 20 to a second end proximal, but spaced from, the rear wall 28. The ribs 34 are spaced apart by a greater amount, preferably 20 percent greater, at their second ends than at their first ends. Adjacent ribs 34 diverge from their first ends toward their second ends by an angle of at least 5 degrees. Ribs 34 comprise narrow, elongate, generally straight, metallic, shock wave distributing elements with a height dimension of 0.051 cm.±0.013 cm and width dimension of 0.178 cm±0.013 cm. Ribs 34 are generally convex downward when viewed in cross-section and blend smoothly into lower surface 36 of crown 22. It will be understood that crown 22 is free of ribs extending transversely between the ribs 34.

The lower surface 36 of the crown 22 has a forward portion and a rearward portion as defined by a midline lying generally parallel to the front wall 20 one-half the distance between a forwardmost point on the front wall 20 and a rearwardmost point on the rear wall 28. The first ends of the ribs 34 terminate in the forward portion of the crown 22 and the second ends of the ribs 34 terminate in the rearward portion of the crown 22.

As shown most clearly in FIG. 2, ribs 34 are arrayed in a pattern such that the longitudinal axes 38 of the ribs 34 radiate from and intersect at a point 40 in space located forward of front wall 20. Point 40 is preferably located within the middle one third (W/3) of the width of front wall 20 and is preferably located substantially in front of the center line of front wall 20. Note that because club head 12 is a three dimensional body, as used herein, point 40 refers to a single point when viewed in plan view as in FIG. 2. Alternatively, point 40 can be thought of as a vertical line consisting of the locus of intersections of vertical planes passing through the center lines of the ribs 34.

Ribs 34 originate at a first location proximal the intersection 42 of the rear surface 44 of front wall 20 and lower surface 36 of crown 22 and extend to a second location proximal rear wall 28. In the illustrative embodiment, at least half, and preferably all of the ribs 34 extend from front wall 20 past the mid-point (L/2) of club head 12 and are not interconnected by any transverse ribs. Accordingly, each rib 34 acts independently of the other ribs 34 interconnected only by the intervening thin section of crown 22 therebetween. Preferably, point 40 is also no more than L/2 forward of front wall 20. This results in a pattern of ten ribs 34 subtending an angle of approximately 60 degrees or an angular divergence of from 4 to 8 degrees, preferably about 6 degrees of divergence between adjacent ribs 34.

The surprising result of this arrangement of ribs 34 is that although an array of perpendicular ribs 0.051 cm high by 0.178 cm wide results in only a 9% reduction in maximum stress as compared with unreinforced crown region, ribs 34 arranged in a radial fan pattern in accordance with the present invention reduce maximum stress in the crown region by almost 36%. Although not wishing to be held to any particular theory of operation, it is believed that because the face 20 itself deforms non-uniformly extending outward from the point of impact, the loads are transferred to the crown region in a similar non-uniform manner radiating outward from the point of impact. Therefore, arranging the ribs 34 in a radial pattern extending out from near the point of impact yields a crown 22 that more efficiently supports the face 20 during impact.

In addition to straight linear ribs with substantially constant widths and heights as demonstrated in the example of FIGS. 1-3, it is possible to have alternate embodiments of a golf club head with ribs. For example, the ribs can be curved or the heights and/or widths of the ribs can be varied.

Figure 4:
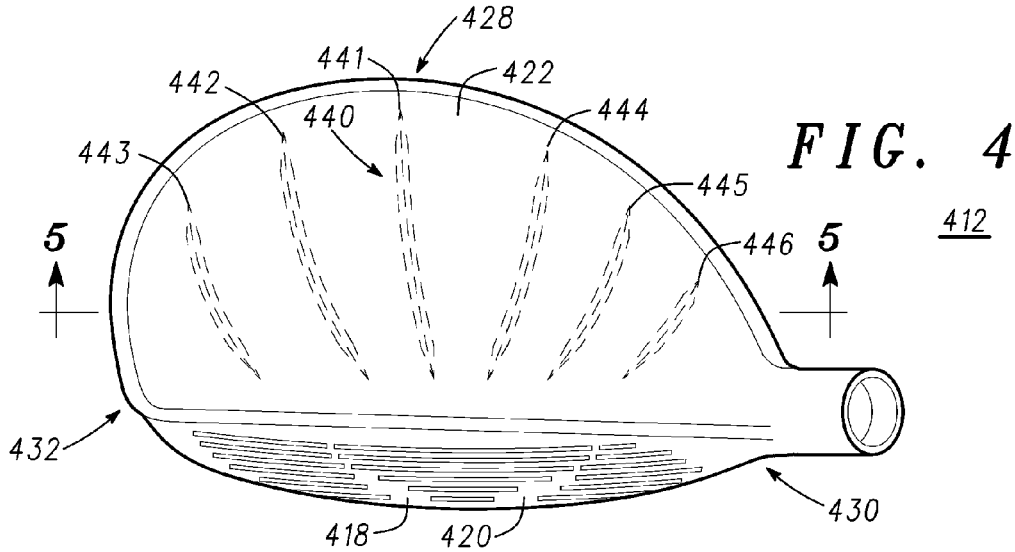
FIG. 4 is a top view of a golf club head, according to a second embodiment.
Figure 5:
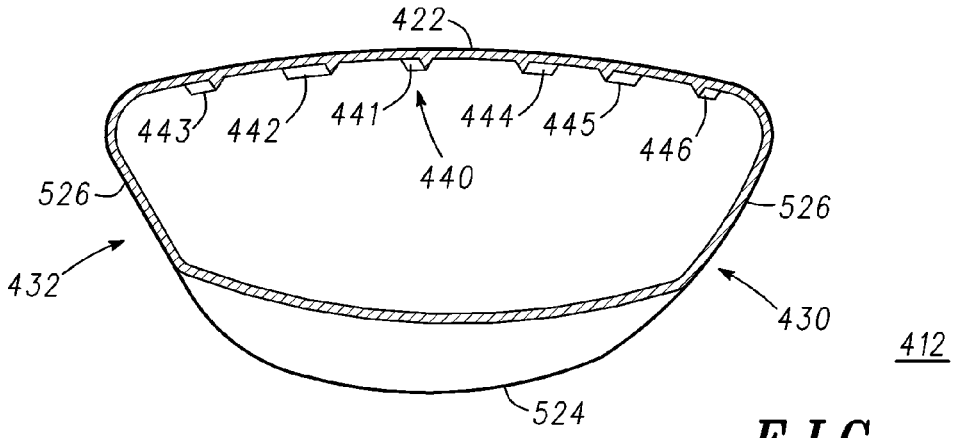
FIG. 5 is a full cross-sectional view of the club head of FIG. 4 viewed from the front.

As an example, FIG. 4 illustrates another embodiment of a golf club head. FIG. 5 illustrates a cross-sectional view of the embodiment of FIG. 4 taken at the lines labeled "5." Golf club head 412 (FIG. 4) includes a hollow body 418 (FIG. 4) with a front wall 420 (FIG. 4), a crown 422 (FIG. 4), a sole 524 (FIG. 5), a side wall 526 (FIG. 5) connecting crown 422 and sole 524, a heel end 430 (FIG. 4), a toe end 432 (FIG. 4), and a rear side 428 (FIG. 4) that is opposite of front wall 420. In addition, golf club head 412 can also include ribs 440 (FIG. 4) that extend downwardly from the lower surface of crown 422. In the example of the embodiment illustrated in FIG. 4, ribs 440 comprise ribs 441, 442, 443, 444, 445, and 446 that have a first end that is proximal to front wall 420 and a second end that is proximal to rear side 428.

In some examples, one or more of ribs 440 can be curved. As an example, each of ribs 441, 442, 443, 444, 445, and 446 are curved in the example of FIG. 4. In other examples, however, some of ribs 440 may not be curved. For example, rib 441 can be linear. When ribs 440 are curved, the length of ribs 440 can be increased. A longer rib allows for more of the rib to absorb the vibration.

Each of ribs 440 of FIG. 4 are curved. In some examples, ribs 440 can be curved in different directions. For example, ribs 441, 442, and 443 can be curved in one direction, while ribs 444, 445, and 446 can be curved in the opposite direction. Ribs 441, 442, and 443 are curved convexly with respect to toe end 432. Therefore, the first end and second end of ribs 441, 442, and 443 are curved away from toe 432 end towards heel end 430. On the other hand, ribs 444, 445, and 446 are curved convexly with respect to heel end 430. Therefore, the first end and second end of ribs 444, 445, and 446 are curved away from heel end 430 towards toe end 432. In one example, at least two of ribs 440 would intersect if extended forwardly in a linear or curved fashion toward front wall 420. For example, the linear extension of rib 442 would intersect with the linear extension of rib 444 near front wall 420 or, in a different embodiment, in front of front wall 420. It should be noted that there may be alternate curve arrangements for ribs 440. For example, more ribs of ribs 440 may curve towards one direction than the other, or all the ribs may curve in the same direction. In addition, there may be less or more than six ribs 440.

Each of ribs 440 can have a radius of curvature. A radius of curvature is the radius of the circle that is created by an extrapolation of the rib. In some examples, each of ribs 440 has a different radius of curvature. In other examples, some of the radii can be approximately equal to each other.

In the example of golf club head 412 illustrated in FIG. 4, rib 441 has the largest radius of curvature. The radius of curvature of the subsequent ribs decreases the closer the rib is to heel end 430 or toe end 432 relative to rib 441. For example, the radius of curvature of rib 442 is less than that of rib 441, and the radius of curvature of rib 443 is less than that of rib 442. Furthermore, the radius of curvature of rib 444 is less than that of rib 441; the radius of curvature of rib 445 is less than that of rib 444; and the radius of curvature of rib 446 is less than that of rib 445. In other examples the radii of curvature of ribs 440 can increase the closer the rib is to heel end 430 or toe end 432 relative to rib 441. In yet other examples, the radii of curvature of ribs 440 can have no relation to the rib's position relative to rib 441.

In the same or other examples, the radii of curvature for the ribs can be symmetric with each other according to their position relative to rib 441. For example, the radius of curvature of rib 442 can be approximately equal to the radius of curvature of rib 444, and the radius of curvature of rib 443 can be approximately equal to the radius of curvature of rib 445. In other examples, the radii of curvature for ribs 440 are asymmetric with each other.

Each of ribs 440 has a width dimension. In the example of FIG. 4, each of ribs 440 has a width that is approximately equal to the other ribs. In other examples, ribs 440 can have widths that are not equal to every other rib. In some examples, each of ribs 440 has a tapering first end and a tapering second end. In other examples, there is no tapering of the first end and/or the second end.

In addition, each of ribs 440 has a height dimension. The height dimension is a measure of the distance that a rib extends from crown 422 into hollow body 418. In the example of FIG. 5, each of ribs 440 has a height that is approximately equal to the heights of each of the other ribs. In other examples, ribs 440 can have heights that are not equal to the other ribs.

Each of ribs 440 has a length dimension also. The length dimension is a measure of the (curved) distance between a rib's first end and its second end. In the example of FIG. 4, the ribs towards the midpoint between toe end 432 and heel end 430 have the greatest length. In addition, the length of a rib decreases the closer the rib is to toe end 432 or heel end 430. As an example, rib 441 has the greatest length; the length of rib 442 is greater than that of rib 443; the length of rib 444 is greater than that of rib 445; and the length of rib 445 is greater than that of rib 446. In other examples, all of ribs 440 have an approximately equal length.

Figure 6:
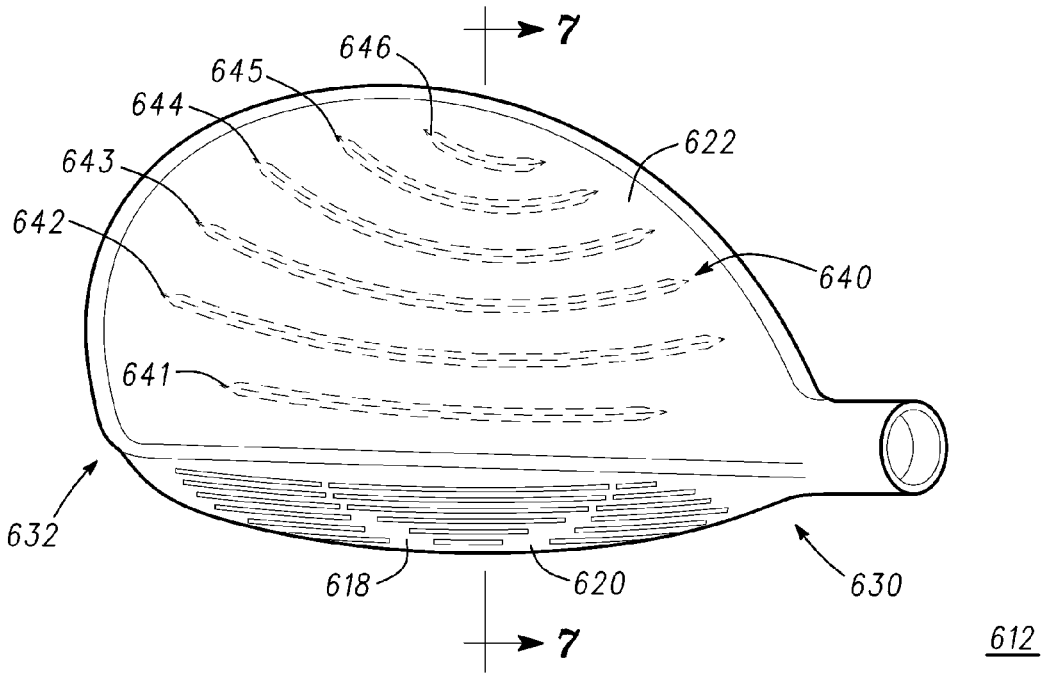
FIG. 6 is a top view of a golf club head, according to a third embodiment.
Figure 7:
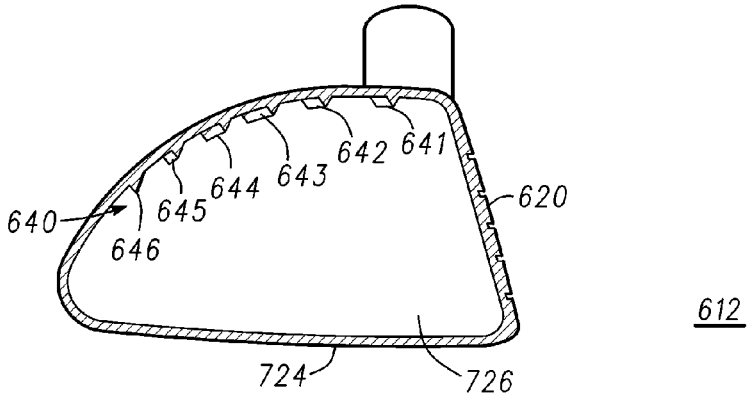
FIG. 7 is a full cross-sectional view of the club head of FIG. 6 viewed from the side.

FIG. 6 illustrates another embodiment of a golf club head. FIG. 7 illustrates a cross-sectional view of the embodiment of FIG. 6 taken at the lines labeled "7." Golf club head 612 (FIG. 6) includes a hollow body 618 (FIG. 6) with a front wall 620 (FIG. 6), a crown 622 (FIG. 6), a sole 724 (FIG. 7), a side wall 726 (FIG. 7) connecting crown 622 and sole 624, a heel end 630 (FIG. 6), a toe end 632 (FIG. 6), and a rear side 628 (FIG. 6). In addition, golf club head 612 can also include ribs 640 (FIG. 6) that extend downwardly from the lower surface of crown 622. In the example of the embodiment illustrated in FIG. 6, ribs 640 comprise ribs 641, 642, 643, 644, 645, and 646 that have a first end that is proximal to toe end 632 and a second end that is proximal to heel end 630.

In some examples, one or more of ribs 640 can be curved. As an example, each of ribs 641, 642, 643, 644, 645, and 646 are curved in the example of FIG. 6. In other examples, however, some of ribs 640 may not be curved. For example, rib 641 can be linear.

Each of ribs 640 of FIG. 6 are curved. In some examples, ribs 640 are all curved in the same direction. For example, ribs 641, 642, 643, 644, 645, and 646 are curved convexly with respect to front wall 620. Therefore, the first end and second end of ribs 640 are curved away from front wall 620. It should be noted that there may be alternate curve arrangements for ribs 640. For example, if the dimensions of golf club head 612 decrease significantly at rear side 628 relative to front wall 620, some of ribs 640 may be curved concavely with respect to front wall 602. In other embodiments, some of ribs 640 may have a first end that is proximal to front wall 620 and a second end that is proximal to rear side 628. In addition, there may be less or more than six ribs 440.

Each of ribs 640 can have a radius of curvature. In some examples, each of ribs 640 has a different radius of curvature. In other examples, some of the radii of curvature can be approximately equal to each other.

In the example of golf club head 612 illustrated in FIG. 6, rib 641 has the largest radius of curvature. The radius of curvature of the subsequent ribs decreases the closer the rib is to rear end 628. For example, the radius of curvature of rib 642 is less than that of rib 641; the radius of curvature of rib 643 is less than that of rib 642; the radius of curvature of rib 644 is less than that of rib 643; the radius of curvature of rib 645 is less than that of rib 644; and the radius of curvature of rib 646 is less than that of rib 645. In other examples, the radii of curvature of ribs 640 can increase for each rib that is closer to rear 628. In yet other examples, the radii of curvature of ribs 640 have no relation to the rib's position relative to rear end 628.

Each of ribs 640 has a width dimension. In the example of FIG. 6, each of ribs 640 has a width that is approximately equal to the other ribs. In other examples, ribs 640 can have widths that are not equal to the other ribs. In some examples, each of ribs 640 has a tapering first end and a tapering second end. In other examples, there is no tapering of the first end and/or the second end.

In addition, each of ribs 640 has a height dimension. The height dimension is a measure of the distance that a rib extends from crown 622 into hollow body 618. In the example of FIG. 7, each of ribs 640 have a height that is approximately equal to the heights of each of the other ribs. In other examples, ribs 640 can have heights that are not equal to the other ribs.

Each of ribs 640 has a length dimension also. The length dimension is a measure of the (curved) distance between a rib's first end and its second end. In the example of FIG. 6, the ribs closer to front wall 620 generally have a greater length than the ribs closer to rear side 628. As an example, the length of rib 642 is greater than that of rib 643; the length of rib 643 is greater than that of rib 644; the length of rib 644 is greater than that of rib 645; and the length of rib 645 is greater than that of rib 646. The length of rib 642, however, is greater than that of rib 641. In other examples, all of ribs 640 have an approximately equal length.

Figure 8:
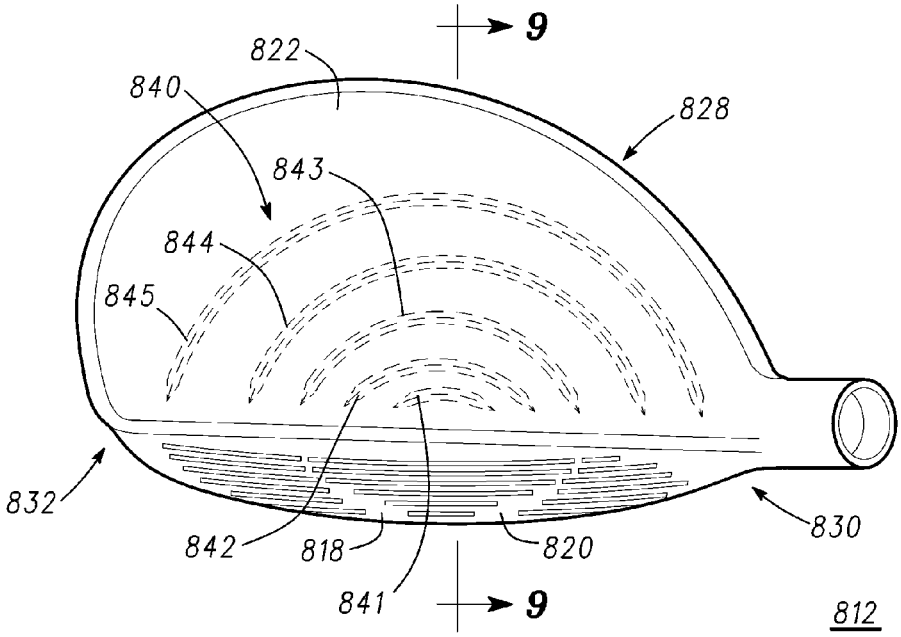
FIG. 8 is a top view of a golf club head, according to a fourth embodiment.
Figure 9:
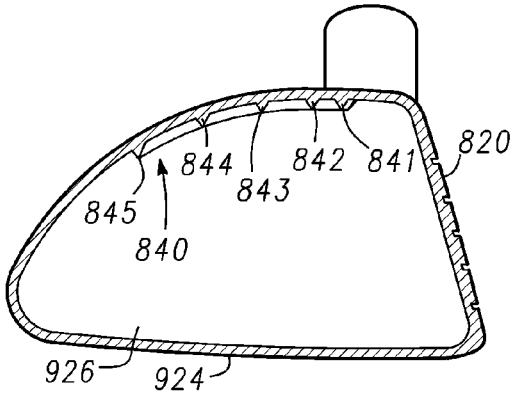
FIG. 9 is a full cross-sectional view of the club head of FIG. 8 viewed from the side.

FIG. 8 illustrates another embodiment of a golf club head. FIG. 9 illustrates a cross-sectional view of the embodiment of FIG. 8 taken at the lines labeled "9." Golf club head 812 (FIG. 8) includes a hollow body 818 (FIG. 8) with a front wall 820 (FIG. 8), a crown 822 (FIG. 8), a sole 924 (FIG. 9), a side wall 926 (FIG. 9) connecting crown 422 and sole 524, a heel end 830 (FIG. 8), a toe end 832 (FIG. 8), and a rear side 828 (FIG. 8) that is opposite of front wall 820. In addition, golf club head 812 can also include ribs 840 (FIG. 8) that extend downwardly from the lower surface of crown 822. In the example of the embodiment illustrated in FIG. 8, ribs 840 comprise ribs 841, 842, 843, 844, and 845 that have a first end that is proximal to toe end 832 and a second end that is proximal to heel end 830.

In some examples, one or more of ribs 840 can be curved. As an example, each of ribs 841, 842, 843, 844, and 845 are curved in the example of FIG. 8. In other examples, however, some of ribs 840 may not be curved. For example, rib 841 can be linear.

Each of ribs 840 of FIG. 8 are curved. In some examples, ribs 840 are all curved in the same direction. For example, ribs 841, 842, 843, 844, and 845 are curved concavely with respect to front wall 820. Therefore, the first end and second end of ribs 840 are curved toward front wall 820. It should be noted that there may be alternate curve arrangements for ribs 840. For example, some of ribs 840 may have a first end that is proximal to front wall 820 and a second end that is proximal to rear side 828. In addition, there may be less or more than six ribs 840.

Each of ribs 840 has a radius of curvature. In some examples, each of ribs 840 has a different radius of curvature. In other examples, some of the radii can be approximately equal.

In the example of golf club head 812 illustrated in FIG. 8, rib 841 has the smallest radius of curvature. The radius of curvature of the subsequent ribs increases the closer the rib is to rear end 828. For example, the radius of curvature of rib 842 is greater than that of rib 841; the radius of curvature of rib 843 is greater than that of rib 842; the radius of curvature of rib 844 is greater than that of rib 843; and the radius of curvature of rib 845 is greater than that of rib 844. In other examples the radii of curvature of ribs 840 can decrease for each rib that is closer to rear end 828. In yet other examples, the radii of curvature of ribs 840 have no relation to the rib's position relative to rear end 828.

In the same or other examples, the radii of curvature for the ribs can be such that the ribs are concentric. If each of ribs 840 was extrapolated to complete a circle, the resulting circles would be concentric. In other examples, the radii of curvature for ribs 840 are not concentric.

Each of ribs 840 has a width dimension. In the example of FIG. 8, each of ribs 840 has a width that is approximately equal to the other ribs. In other examples, ribs 840 can have widths that are not equal to the other ribs. In some examples, each of ribs 840 has a tapering first end and a tapering second end. In other examples, there is no tapering of the first end and/or the second end.

In addition, each of ribs 840 has a height dimension. The height dimension is a measure of the (curved) distance that a rib extends from crown 822 into hollow body 818. In the example of FIG. 9, each of ribs 840 has a height that is approximately equal to the heights of the other ribs. In other examples, ribs 840 can have heights that are not equal to the other ribs.

Each of ribs 840 has a length dimension also. The length dimension is a measure of the distance between a rib's first end and its second end. In the example of FIG. 8, the ribs closer to rear side 828 have a greater length than the ribs closer to front wall 820. As an example, rib 845 has the greatest length; the length of rib 844 is greater than that of rib 843; the length of rib 843 is greater than that of rib 842; and the length of rib 842 is greater than that of rib 841. In other examples, all of ribs 840 have an approximately equal length.

Figure 10:
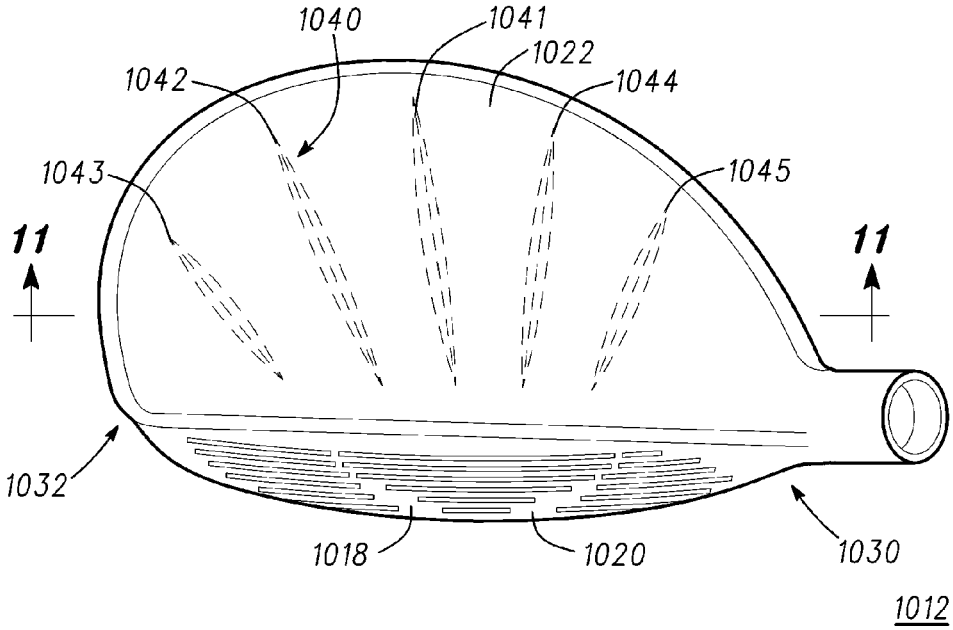
FIG. 10 is a top view of a golf club head, according to a fifth embodiment.
Figure 11:
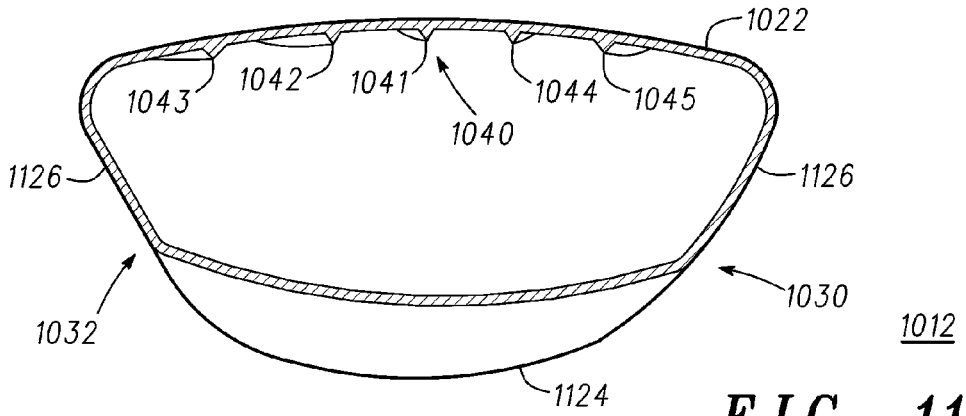
FIG. 11 is a full cross-sectional view of the club head of FIG. 10 viewed from the front.

In addition to having curved ribs, a golf club head can have ribs that have varying widths. For example. FIG. 10 illustrates another embodiment of a golf club head. FIG. 11 illustrates a cross-sectional view of the embodiment of FIG. 10 taken at the lines labeled "11." Golf club head 1012 (FIG. 10) includes a hollow body 1018 (FIG. 10) with a front wall 1020 (FIG. 10), a crown 1022 (FIG. 10), a sole 1124 (FIG. 11), a side wall 1126 (FIG. 11) connecting crown 1022 and sole 1124, a heel end 1030 (FIG. 10), a toe end 1032 (FIG. 10), and a rear side 1028 (FIG. 10) that is opposite of front wall 1020. In addition, golf club head 1012 can also include ribs 1040 (FIG. 10) that extend downwardly from the lower surface of crown 1022. In the example of the embodiment illustrated in FIG. 10, ribs 1040 comprise ribs 1041, 1042, 1043, 1044, and 1045 that have a first end that is proximal to front wall 1020 and a second end that is proximal to rear end 1028.

In some examples, one or more of ribs 1040 are linear. As an example, each of ribs 1041, 1042, 1043, 1044, and 1045 are linear in the example of FIG. 10. In other examples, however, some of ribs 1040 may not be linear. For example, one or more of ribs 1040 can be curved. In some examples, ribs 1040 are arranged so that each of the axes of ribs 1040 converge at a common point. In some examples, the common point is forward of the front wall. In other examples, each of the axes of ribs 1040 do not converge at a common point.

Each of ribs 1040 has a width dimension. In the example of FIG. 10, each of ribs 1040 has a width that tapers. For example, the width of each of ribs 1040 decreases from its midpoint to its first end and its second end. As demonstrated in FIG. 10, the width at the midpoint of each of ribs 1040 can be approximately equal to the width of each of the other ribs at their respective midpoints. In other examples, ribs 1040 can have widths at their midpoints that are not equal to the width of the other ribs at their respective midpoints.

The widths of ribs 1040 can taper at any rate. For example, as illustrated in FIG. 10, the widths can have a smooth, non-constant tapering, giving ribs 1040 the shape of an elongated oval. In other examples, the widths can taper in a linear or constant manner, giving ribs 1040 a shape similar to that of a diamond.

In addition, each of ribs 1040 has a height dimension. The height dimension is a measure of the distance that a rib extends from crown 1022 into hollow body 1018. In the example of FIG. 11, each of ribs 1040 has a height that tapers. For example, the height of each of ribs 1040 decreases from its midpoint to its first end and its second end. As demonstrated in FIG. 11, each of ribs 1040 can have a height that is approximately equal to the heights of the other ribs at their respective midpoints. In other examples, ribs 1040 can have heights at their midpoints that are not equal to the height of the other ribs at their respective midpoints.

The heights of ribs 1040 can taper at any rate. For example, as illustrated in FIG. 11, the widths can have a smooth, non-constant tapering, giving ribs 1040 a smooth contour. In other examples, the widths can taper more drastically or in a linear or constant manner, giving ribs 1040 a shape having a much more pointed height at the midpoint of ribs 1040.

Each of ribs 1040 has a length dimension also. The length dimension is a measure of the distance between a rib's first end and its second end. In the example of FIG. 10, the ribs closer to the midpoint between toe end 1032 and heel end 1030 have a greater length than the ribs closer to toe end 1032 or heel end 1030. As an example, rib 1041 has the greatest length; the length of rib 1042 is greater than that of rib 1043; and the length of rib 1044 is greater than that of rib 1045. In other examples, all of ribs 1040 have an approximately equal length.

Figure 12:
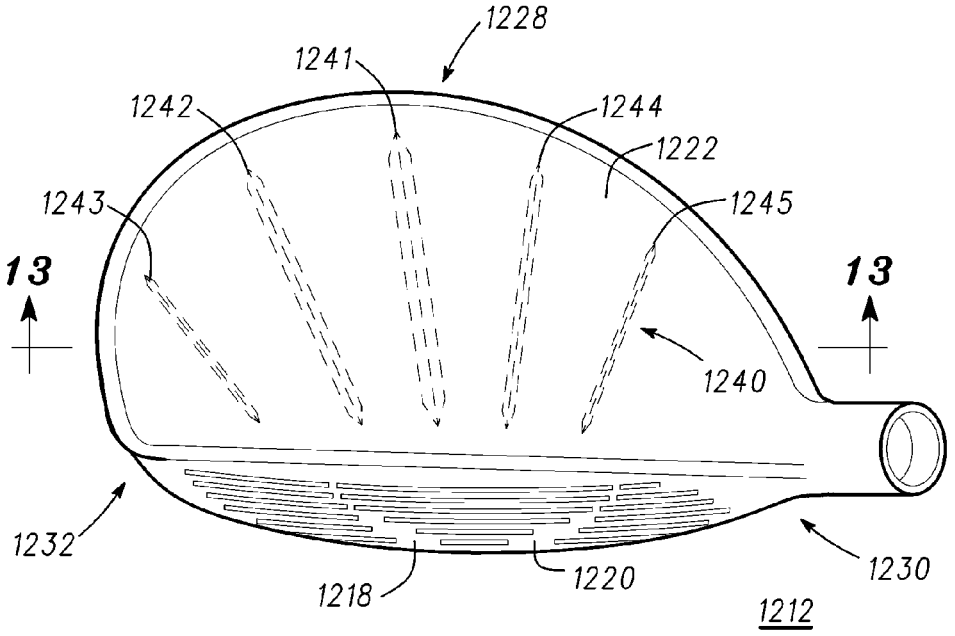
FIG. 12 is a top view of a golf club head, according to a first embodiment.
Figure 13:
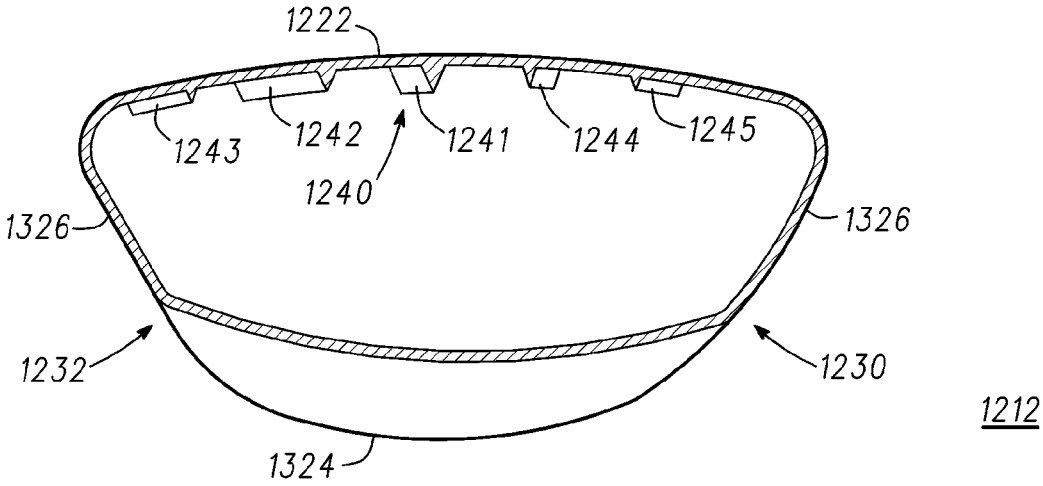
FIG. 13 is a full cross-sectional view of the club head of FIG. 12 viewed from the front.

FIG. 12 illustrates another embodiment of a golf club head. FIG. 13 illustrates a cross-sectional view of the embodiment of FIG. 12 taken at the lines labeled "13." Golf club head 1212 (FIG. 12) includes a hollow body 1218 (FIG. 12) with a front wall 1220 (FIG. 12), a crown 1222 (FIG. 12), a sole 1324 (FIG. 13), a side wall 1326 (FIG. 13) connecting crown 1222 and sole 1324, a heel end 1230 (FIG. 12), a toe end 1232 (FIG. 12), and a rear side 1228 (FIG. 12) that is opposite of front wall 1220. In addition, golf club head 1212 can also include ribs 1240 (FIG. 12) that extend downwardly from the lower surface of crown 1222. In the example of the embodiment illustrated in FIG. 12, ribs 1240 comprise ribs 1241, 1242, 1243, 1244, and 1245 that have a first end that is proximal to front wall 1220 and a second end that is proximal to rear end 1228.

In some examples, one or more of ribs 1240 are linear. As an example, each of ribs 1241, 1242, 1243, 1244, and 1245 are linear in the example of FIG. 12. In other examples, however, some of ribs 1240 may not be linear. For example, one or more of ribs 1240 can be curved. In some examples, ribs 1240 are arranged so that each of the axes of ribs 1240 converge at a common point. In some examples, the common point is forward of the front wall. In other examples, each of the axes of ribs 1240 do not converge at a common point.

Each of ribs 1240 has a width dimension. In the example of FIG. 12, each of ribs 1240 has a width that remains substantially constant. In some examples, the width of each of ribs 1240 tapers at its first end and its second end. In other examples, the width of each of ribs 1240 does not taper at its first and/or second end. As demonstrated in FIG. 12, the width of each of ribs 1040 can vary. For example, the closer a rib is to the midpoint between toe end 1232 and heel end 1230, the greater the width of that particular rib. As illustrated in FIG. 12, rib 1241 can have the largest width; the width of rib 1242 is greater than width of rib 1243; and the width of rib 1244 is greater that the width of rib 1245. In some examples, the widths of ribs 1240 are symmetric across golf club head 1212. For example, the width of rib 1243 is approximately equal to the width of rib 1245, and the width of rib 1242 is approximately equal to the width of rib 1244. In other examples, the widths of ribs 1240 are asymmetric across golf club head 1212. In yet other examples, the widths of ribs 1240 can change such as, for example, by increasing the closer the rib is to toe end 1232 or heel end 1230. In further examples, the widths of ribs 1240 have no correlation to the rib's position relative to toe end 1232 and/or heel end 1230. Ribs 1240 can be positioned so that the ribs with greater widths can be placed in areas of higher vibration.

In addition, each of ribs 1240 has a height dimension. The height dimension is a measure of the distance that a rib extends from crown 1222 into hollow body 1218. In the example of FIG. 13, each of ribs 1240 has a height that remains substantially constant. As also demonstrated in FIG. 13, each of ribs 1240 can have a height that is different from the height of at least one of the other ribs. In some examples, the height of ribs 1240 increases the closer a rib is to the midpoint between toe end 1232 and heel end 1230. As illustrated in FIG. 12, rib 1241 can have the largest height; the height of rib 1242 is greater than height of rib 1243; and the height of rib 1244 is greater that the height of rib 1245. In some examples, the heights of ribs 1240 are symmetric across golf club head 1212. For example, the height of rib 1243 is approximately equal to the height of rib 1245, and the height of rib 1242 is approximately equal to the height of rib 1244. In other examples, the heights of ribs 1240 are asymmetric across golf club head 1212. In yet other examples, the heights of ribs 1240 can change, such as, for example, by increasing the closer the rib is to toe end 1232 and heel end 1230. In further examples, the height of ribs 1240 has no correlation to the rib's position relative to toe end 1232 and/or heel end 1230. Ribs 1240 can be positioned so that the ribs with greater heights can be placed in areas of higher vibration.

Each of ribs 1240 has a length dimension also. The length dimension is a measure of the distance between a rib's first end and its second end. In the example of FIG. 12, the ribs closer to the midpoint between toe end 1232 and heel end 1230 have a greater length than the ribs closer to toe end 1232 or heel end 1230. As an example, rib 1241 has the greatest length; the length of rib 1242 is greater than that of rib 1243; and the length of rib 1244 is greater than that of rib 1245. In other examples, all of ribs 1240 have an approximately equal length.

In other embodiments, ribs can have widths and/or heights that taper and vary from one rib to the next. For examples, ribs can have tapering widths as illustrated by ribs 1040 of FIG. 10, and ribs can have varying widths as illustrated by ribs 1240 of FIG. 12. In addition, ribs can have tapering heights as illustrated by ribs 1040 of FIG. 11, and ribs can have a varying heights as illustrated by ribs 1240 of FIG. 13.

In another embodiment, a method of providing a golf club head is provided. The method of providing a golf club head can include providing a body having a heel end, a toe end, a crown having an upper surface and a lower surface, a sole, a front wall, a rear side, and ribs extending from a first end to a second end and extending downwardly from the lower surface of the crown. In addition, the ribs can comprise a first rib and at least one second rib that is curved. As an example, the heel end can be heel end 430 (FIG. 4), heel end 630 (FIG. 6), or heel end 830 (FIG. 8); the toe end can be toe end 432 (FIG. 4), toe end 632 (FIG. 6), or toe end 832 (FIG. 8); the crown can be crown 422 (FIG. 4), crown 622 (FIG. 6), or crown 822 (FIG. 8); the sole can be sole 524 (FIG. 5), sole 724 (FIG. 7), or sole 924 (FIG. 9); the front wall can be front wall 420 (FIG. 4), front wall 620 (FIG. 6), or front wall 820 (FIG. 8); the rear side can be rear side 428 (FIG. 4), rear side 628 (FIG. 6), or rear side 828 (FIG. 8); and ribs can be ribs 440 (FIG. 4), ribs 640 (FIG. 6), or ribs 840 (FIG. 8).

In one example, the ribs can be provided to be integral with the body. In other examples, the ribs can be provided to be initially separate from the body. Afterwards, the ribs can be coupled to the body by way of a brazing technique, a welding technique, or an adhesive.

In yet another embodiment, a method of providing a golf club head is provided. The method of providing a golf club head can include providing a body having a heel end, a toe end, a crown having an upper surface and a lower surface, a sole, a front wall, a rear side, and generally linear ribs extending downwardly from the lower surface of the crown and extending from a first end proximal the front wall to a second end proximal the rear side. In some examples, the ribs can have a tapering width from its midpoint towards its ends. In the same or other examples, the widths of at least two of the ribs are different. As an example, the heel end can be heel end 1030 (FIG. 10) or heel end 1230 (FIG. 12); the toe end can be toe end 1032 (FIG. 10) or toe end 1232 (FIG. 12); the crown can be crown 1022 (FIG. 10) or crown 1222 (FIG. 12); the sole can be sole 1124 (FIG. 11) or sole 1324 (FIG. 13); the front wall can be front wall 1020 (FIG. 10) or front wall 1220 (FIG. 12); the rear side can be rear side 1028 (FIG. 10) or rear side 1228 (FIG. 12); and ribs can be ribs 1040 (FIG. 10) or ribs 1240 (FIG. 12).

In one example, the ribs can be provided to be integral with the body. In other examples, the ribs can be provided to be initially separate from the body. Afterwards, the ribs can be coupled to the body by way of a brazing technique, a welding technique, or an adhesive.

Although certain illustrative embodiments and methods have been described herein, it will be apparent from the foregoing disclosure to those skilled in the art that variations and modifications of such embodiments and methods may be made without departing from the spirit and scope of the invention. Accordingly it is intended that the invention should be limited only to the extent required by the appended claims and the rules and principles of applicable law.

The invention claimed is:

1. A golf club head comprising:
a body comprising:
a heel end, a toe end, a crown, a sole, a front wall, and a rear side;
an interior surface defined by the heel end, the toe end, the crown, the sole, the front wall and the rear side; and
an interior cavity bounded by the interior surface;
and
ribs extending from the interior surface of the crown into the interior cavity;
wherein:
the ribs comprise:
a first rib at a first rib surface location of the interior surface;
a second rib at a second rib surface location of the interior surface; and
a third rib at a third rib surface location of the interior surface;
the first rib comprises:
a first rib length extending along the first rib surface location; and
a first rib dimension other than the first rib length;
the second rib comprises:
a second rib length extending along the second rib surface location; and
a second rib dimension other than the second rib length;
the third rib comprises:
a third rib length extending along the third rib surface location; and
a third rib dimension other than the third rib length;
the first rib dimension is greater than the second rib dimension and the third rib dimension; and
the second and third ribs are located at opposite sides of the first rib.

2. The golf club head of claim 1, wherein:
the first rib dimension comprises one of:
a first rib height protruding from the first rib surface location; or
a first rib width extending along the first rib surface location;
if the first rib dimension comprises the first rib height:

the second rib dimension comprises a second rib height protruding from the second rib surface location; and if the first rib dimension comprises the first rib width:

the second rib dimension comprises a second rib width extending along the second rib surface location.

3. The golf club head of claim 2, wherein:

the first rib height protrudes substantially perpendicularly from the first rib surface location.

4. The golf club head of claim 2, wherein:

the first rib height comprises a maximum rib height of the first rib; and the second rib height comprises a maximum rib height of the second rib.

5. The golf club head of claim 2, wherein:

the ribs comprise at least one of:

the first rib height varying along the first rib length; or the second rib height varying along the second rib length.

6. The golf club head of claim 1, wherein:

the first rib dimension tapers towards opposite ends of the first rib.

7. The golf club head of claim 6, wherein:

the first rib dimension increases towards a midpoint of the first rib.

8. The golf club head of claim 1, wherein:

each of the ribs extends from proximate the heel end to proximate the toe end of the body.

9. The golf club head of claim 1, wherein:

each of the ribs extends from proximate the front wall to proximate the rear side of the body.

10. The golf club head of claim 1, wherein:

the ribs further comprise:

a fourth rib at a fourth rib surface location of the interior surface and comprising:

a fourth rib length extending along the fourth rib surface location; and a fourth rib dimension other than the fourth rib length;

and a fifth rib at a fifth rib surface location of the interior surface and comprising:

a fifth rib length extending along the fifth rib surface location; and a fifth rib dimension other than the fifth rib length;

the second rib is located between the first and fourth ribs;

the third rib is located between the first and fifth ribs;

the third rib dimension is greater than the fifth rib dimension; and the second rib dimension is greater than the fourth rib dimension.

11. The golf club head of claim 1, wherein:

each of the ribs comprises:

a rib first end located towards one of the heel end, the toe end, the front wall, or the rear side of the body; and a rib second end located opposite the rib first end towards a different one of the heel end, the toe end, the front wall, or the rear side of the body;

and distances separating the rib first ends of adjacent ribs of the ribs are greater than distances separating the rib second ends of the adjacent ribs of the ribs.

12. A golf club head comprising:

a body comprising:

a heel end, a toe end, a crown, a sole, a front wall, and a rear side;

an interior surface defined by the heel end, the toe end, the crown, the sole, the front wall and the rear side; and an interior cavity bounded by the interior surface;

and ribs extending from the interior surface of the crown into the interior cavity;

wherein:

the ribs comprise:

a first rib at a first rib surface location of the interior surface; and a second rib at a second rib surface location of the interior surface;

the first rib comprises:

a first rib length extending along the first rib surface location; and a first rib dimension other than the first rib length;

the second rib comprises:

a second rib length extending along the second rib surface location; and a second rib dimension other than the second rib length;

the first rib dimension is greater than the second rib dimension; and at least one of the ribs is curved relative to at least one of:

a heel-to-toe direction between the heel end and the toe end of the body; or a front-to-rear direction between the front wall and the rear side of the body.

13. A golf club head comprising:

a body comprising:

a heel end, a toe end, a crown, a sole, a front wall, and a rear side;

and ribs extending from the crown toward the sole;

wherein:

the ribs comprise:

a first rib at a first rib surface location of the crown; and a second rib at a second rib surface location of the crown;

the first rib comprises:

a first rib length extending along the first rib surface location; and a first rib dimension other than the first rib length;

the second rib comprises:

a second rib length extending along the second rib surface location; and a second rib dimension other than the second rib length;

the first rib dimension is greater than the second rib dimension;

each of the ribs comprises:

a rib first end located towards one of the heel end, the toe end, the front wall, or the rear side of the body; and a rib second end located opposite the rib first end towards a different one of the heel end, the toe end, the front wall, or the rear side of the body;

and distances separating the rib first ends of adjacent ribs of the ribs are greater than distances separating the rib second ends of the adjacent ribs of the ribs.

14. The golf club head of claim 13, wherein:

the first rib dimension comprises one of:

a first rib height protruding from the first rib surface location; or a first rib width extending along the first rib surface location;

if the first rib dimension comprises the first rib height:

the second rib dimension comprises a second rib height protruding from the second rib surface location; and if the first rib dimension comprises the first rib width:

the second rib dimension comprises a second rib width extending along the second rib surface location.

15. The golf club head of claim 14, wherein:

the first rib height comprises a maximum rib height of the first rib;

the second rib height comprises a maximum rib height of the second rib; and the ribs extend into an interior cavity of the body.

16. The golf club head of claim 14, wherein:

the ribs comprise at least one of:

the first rib height varying along the first rib length; or the second rib height varying along the second rib length.

17. The golf club head of claim 14, wherein:

the ribs further comprise:

a third rib at a third rib surface location and comprising:

a third rib length extending along the third rib surface location; and a third rib dimension other than the third rib length;

the second and third ribs are located at opposite sides of the first rib; and the first rib dimension is greater than the second rib dimension and the third rib dimension.

18. The golf club head of claim 13, wherein:

at least one of the ribs is curved relative to at least one of:

a heel-to-toe direction between the heel end and the toe end of the body; or a front-to-rear direction between the front wall and the rear side of the body.

19. A method for providing a golf club, the method comprising:

manufacturing a club head body comprising:

a heel end, a toe end, a crown, a sole, a front wall, and a rear side;

an interior surface defined by the heel end, the toe end, the crown, the sole, the front wall and the rear side;

an interior cavity bounded by the interior surface; and ribs extending from the interior surface of the crown into the interior cavity; and coupling a golf club shaft to the club head body;

wherein:

the ribs comprise:

a first rib at a first rib surface location of the interior surface;

a second rib at a second rib surface location of the interior surface; and a third rib at a third rib surface location of the interior surface;

the first rib comprises:

a first rib length extending along the first rib surface location; and a first rib dimension other than the first rib length;

the second rib comprises:

a second rib length extending along the second rib surface location; and a second rib dimension other than the second rib length;

the third rib comprises:

a third rib length extending along the third rib surface location; and a third rib dimension other than the third rib length;

the first rib dimension is greater than the second rib dimension;

the second and third ribs are located at opposite sides of the first rib; and the first rib dimension is greater than the second rib dimension and the third rib dimension.

20. The method of claim 19, wherein:

the first rib dimension tapers towards opposite ends of the first rib.

21. The method of claim 19, wherein:

each of the ribs extends from proximate the heel end to proximate the toe end of the body.

22. The method of claim 19, wherein:

the ribs further comprise:

a fourth rib at a fourth rib surface location of the interior surface and comprising:

a fourth rib length extending along the fourth rib surface location; and a fourth rib dimension other than the fourth rib length; and a fifth rib at a fifth rib surface location of the interior surface and comprising:

a fifth rib length extending along the fifth rib surface location; and a fifth rib dimension other than the fifth rib length;

the second rib is located between the first and fourth ribs;

the third rib is located between the first and fifth ribs;

the third rib dimension is greater than the fifth rib dimension; and the second rib dimension is greater than the fourth rib dimension.

23. A method for providing a golf club, the method comprising:

manufacturing a club head body comprising:

a heel end, a toe end, a crown, a sole, a front wall, and a rear side;

an interior surface defined by the heel end, the toe end, the crown, the sole, the front wall and the rear side;

an interior cavity bounded by the interior surface; and ribs extending from the interior surface of the crown into the interior cavity;

and providing a golf club shaft configured to couple with the club head body;

wherein:

the ribs comprise:

a first rib at a first rib surface location of the interior surface; and a second rib at a second rib surface location of the interior surface;

the first rib comprises:

a first rib length extending along the first rib surface location; and a first rib dimension other than the first rib length;

the second rib comprises:

a second rib length extending along the second rib surface location; and a second rib dimension other than the second rib length;

the first rib dimension is greater than the second rib dimension;

each of the ribs comprises:

a rib first end located towards one of the heel end, the toe end, the front wall, or the rear side of the club head body; and a rib second end located opposite the rib first end towards a different one of the heel end, the toe end, the front wall, or the rear side of the club head body; and distances separating the rib first ends of adjacent ribs of the ribs are greater than distances separating the rib second ends of the adjacent ribs of the ribs.

* * * * *